US008849656B2

(12) United States Patent
Schmidt et al.

(10) Patent No.: US 8,849,656 B2
(45) **Date of Patent: *Sep. 30, 2014**

(54) SYSTEM ENHANCEMENT OF SPEECH SIGNALS

(75) Inventors: Gerhard Schmidt, Ulm (DE); Mohamed Krini, Ulm (DE)

(73) Assignee: Nuance Communications, Inc., Burlington, MA (US)

( * ) Notice: Subject to any disclaimer, the term of this patent is extended or adjusted under 35 U.S.C. 154(b) by 559 days.

This patent is subject to a terminal disclaimer.

(21) Appl. No.: 13/273,890

(22) Filed: Oct. 14, 2011

(65) Prior Publication Data

US 2012/0109647 A1 May 3, 2012

Related U.S. Application Data

(63) Continuation of application No. 12/269,605, filed on Nov. 12, 2008, now Pat. No. 8,050,914.

(30) Foreign Application Priority Data

Nov. 12, 2007 (EP) ..... 07021932

(51) Int. Cl.

| | |
|---|---|
| ***G10L 21/02*** | (2013.01) |
| ***G10L 21/0208*** | (2013.01) |
| ***H04R 3/00*** | (2006.01) |
| *G10L 21/0216* | (2013.01) |
| *G10L 21/0264* | (2013.01) |

(52) U.S. Cl.

CPC ..... *H04R 3/005* (2013.01); *H04R 2410/05* (2013.01); *G10L 21/0208* (2013.01); *H04R 2499/13* (2013.01); *H04R 2499/11* (2013.01); *G10L 2021/02165* (2013.01); *G10L 21/0264* (2013.01); *H04R 2410/07* (2013.01)

USPC ..... 704/226; 704/221; 704/206; 704/200; 704/223

(58) Field of Classification Search

CPC . G10L 21/02; G10L 21/0205; G10L 21/0208; G10L 21/038; G10L 2021/02; G10L 2021/0216

USPC ..... 704/226, 221, 206, 200, 223

See application file for complete search history.

(56) References Cited

U.S. PATENT DOCUMENTS

| | | | |
|---|---|---|---|
| 5,574,824 | A | 11/1996 | Slyh et al. |
| 6,717,991 | B1 | 4/2004 | Gustafsson et al. |

(Continued)

FOREIGN PATENT DOCUMENTS

| | | | |
|---|---|---|---|
| DE | 10 2005 002 865 | B3 | 6/2006 |
| EP | 0 856 834 | A2 | 8/1998 |

(Continued)

OTHER PUBLICATIONS

European Search Report dated Jun. 14, 2011; for European Pat. App. No. EP 07 02 1932; 2 pages.

(Continued)

*Primary Examiner* — Qi Han

(74) *Attorney, Agent, or Firm* — Daly, Crowley, Mofford & Durkee, LLP

(57) ABSTRACT

A system enhances speech by detecting a speaker's utterance through a first microphone positioned a first distance from a source of interference. A second microphone may detect the speaker's utterance at a different position. A monitoring device may estimate the power level of a first microphone signal. A synthesizer may synthesize part of the first microphone signal by processing the second microphone signal. The synthesis may occur when power level is below a predetermined level.

27 Claims, 7 Drawing Sheets

(56) References Cited

U.S. PATENT DOCUMENTS

| | | | | |
|---|---|---|---|---|
| 8,050,914 | B2 | 11/2011 | Schmidt et al. | |
| 2003/0179888 | A1* | 9/2003 | Burnett et al. | 381/71.8 |
| 2004/0047464 | A1 | 3/2004 | Yu et al. | |
| 2004/0167777 | A1* | 8/2004 | Hetherington et al. | 704/226 |
| 2004/0230428 | A1* | 11/2004 | Choi | 704/226 |
| 2006/0222184 | A1 | 10/2006 | Buck et al. | |
| 2007/0230712 | A1 | 10/2007 | Belt et al. | |

FOREIGN PATENT DOCUMENTS

| | | | |
|---|---|---|---|
| JP | 10-23122 | | 1/1998 |
| WO | WO 2006/117032 | A1 | 11/2006 |

OTHER PUBLICATIONS

Richardson at al. "LPC-Synthesis Mixture: A Low Computational Cost Speech Enhancement Algorithm;" Bringing Together Education; Science and Technology; Proceedings of the IEEE; Apr. 11-14, 1996; pp. 496-499.

U.S. Pat. No. 8,050,914; 226 pages.

Letter from Grünecker Patent-Und Rechtsanwäite dated Dec. 12, 2013; for European Pat. App. No. 07021932.4; 1 page.

Decision to Grant a European Patent dated Dec. 5, 2013; for European Pat. App. No. 07021932.4; 1 page.

* cited by examiner

SYSTEM ENHANCEMENT OF SPEECH SIGNALS

PRIORITY CLAIM

The present application is a U.S. Continuation Patent Application of U.S. patent application Ser. No. 12/269,605, filed on Nov. 12, 2008. The present application and U.S. patent application Ser. No. 12/269,605 itself claim the benefit of priority from European Patent 07021932.4, filed Nov. 12, 2007. Both priority applications are incorporated herein by reference in their entirety.

TECHNICAL FIELD

This disclosure is directed to an enhancement of speech signals that contain noise, and particularly to partial speech reconstruction.

RELATED ART

Two-way speech communication may suffer from effects of localized noise. While hands-free devices provide a comfortable and safe communication medium, noisy environments may severely affect the quality and intelligibility of voice transmissions.

In vehicles, localized sources of interferences (e.g., the air conditioning or a partly opened window), may distort speech signals. To mediate these effects, some systems include noise suppression filters to improve intelligibility.

Some noise suppression filters weight speech signals and preserve background noise. To reconstruct speech, a filter may estimate an excitation signal and a spectral envelope. Unfortunately, in some noisy environments spectral envelope are not reliably estimated. Relatively strong noises may mask content and yield low signal-to-noise ratios. Current systems do not ensure intelligibility and/or a desired speech quality when transmitted through a communication medium.

SUMMARY

A system enhances speech by detecting a speaker's utterance through a first microphone positioned a first distance from a source of interference. A second microphone may detect the speaker's utterance at a different position. A monitoring device may estimate the power level of a first microphone signal. A synthesizer may synthesize part of the first microphone signal by processing the second microphone signal. The synthesis may occur when power level is below a predetermined level.

Other systems, methods, features, and advantages will be, or will become, apparent to one with skill in the art upon examination of the following figures and detailed description. It is intended that all such additional systems, methods, features and advantages be included within this description, be within the scope of the invention, and be protected by the following claims.

BRIEF DESCRIPTION OF THE DRAWINGS

The system may be better understood with reference to the following drawings and description. The components in the figures are not necessarily to scale, emphasis instead being placed upon illustrating the principles of the invention. Moreover, in the figures, like referenced numerals designate corresponding parts throughout the different views.

DETAILED DESCRIPTION OF THE PREFERRED EMBODIMENTS

Figure 1:
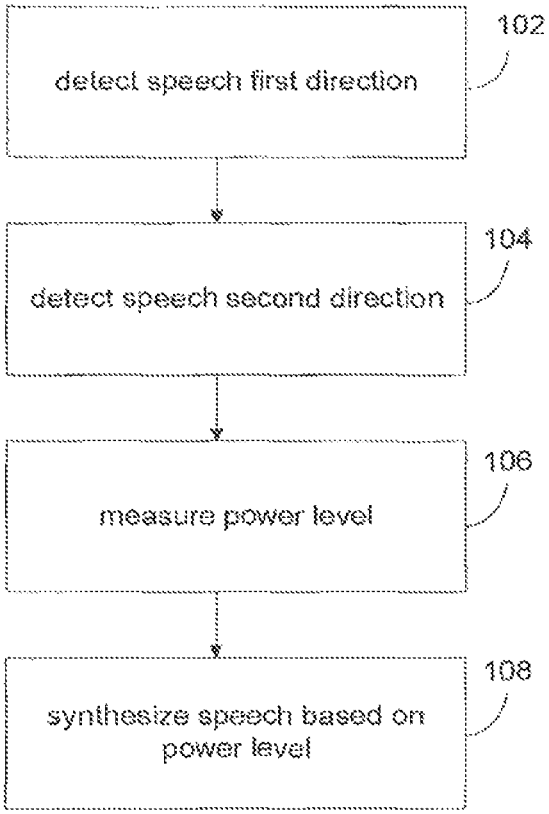
FIG. 1 is a speech enhancement process.

A speech synthesis method may synthesize an input signal affected by distortion. The interference may occur during signal reception. The method of FIG. 1 may detect a speaker's utterance through a device that converts sound waves into analog signals or digital data (e.g., a first input signal) at 102. The input device (or devices, microphones, microphone arrays, etc.) may be positioned at a first distance from a source of interference (noise). The input may detect a direction of the noise flowing from the source of interference. A second device may convert sound waves into analog signals or digital data (e.g., a second input signal) at 104. The second input device (or devices, microphones, microphone arrays, etc.) may be positioned at a second distance from the source of interference. The separation may be larger than the first distance and/or the interference may be received from a second direction. The interference received from the second input may have a lower intensity than the interference received from the first direction. The speech synthesis method measures power at 106 by which the first input signal exceeds the channel noise at a point in the transmission (e.g., a signal-to-noise ratio). The method synthesizes part of the first input signal in which the signal power is below a predetermined level at 108. The synthesis may be based on the second input signal.

When a microphone receives sound the first input signal may be designated a first microphone signal and the second input signal may be designated a second microphone signal. The first microphone signal may include noise received from a source of interference (e.g., a vehicle fan that promotes air flow through a cooling or heating system). Through a speech synthesis method a first microphone signal is enhanced through the content of a second microphone signal. The second microphone signal may include less noise (or almost no noise) originating from a common source. The difference may be due input to the microphone positions. A second microphone may be positioned further away from the source of interference or focused in a direction less affected by the interference. Portions of a speech signal that are heavily affected by noise may be synthesized from the information conveyed through a second microphone signal that also includes content or speech.

A synthesis may reconstruct (or model) signal segments through a partial speech synthesis. In some methods the process re-synthesizes signal portions having low signal-to-noise ratio (SNR) to obtain corresponding signals that include the synthesized (or modeled) desired signals. A short-time power spectrum of the noise may be estimated in relation to the short-time power spectrum of a microphone (or another input) signal to obtain an estimate.

In the speech synthesis method a microphone signal may be enhanced through the information included in a second microphone signal that is positioned away from the first microphone. In some systems a second microphone signal may be obtained by another microphone positioned in proximity to a speaker to detect the speaker's utterance. The second microphone may be part of or couple a vehicle interior and may communicate with a speech dialog system or hands-free communication system. In some systems, the second microphone may be part of a mobile device, e.g., a mobile phone, a personal digital assistant, or a portable navigation device. A user (speaker) may place the second microphone (e.g., by positioning the mobile device) at a location or position that detects less noise. The location may minimize interference transmitted by localized sources (e.g., such air jets of a heating and cooling system, an output of an audio system, near an engine, tires, window, etc.).

Figure 2:
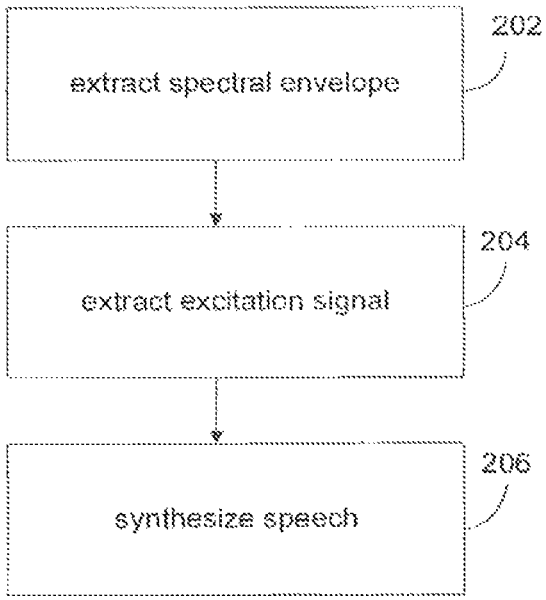
FIG. 2 is an alternative speech enhancement process.

Some system may process the information contained in the second microphone signal (e.g., the less noisy signal) to extract (or estimate) a spectral envelope. When a first microphone signal is susceptible to noise (e.g., a signal-to-noise ratio fall below a predetermined level) the signal may be synthesized. The method of FIG. 2 may extract a spectral envelope at 202 (or characteristics of a spectral envelope) from the second microphone signal and extract an excitation signal at 204 from the first microphone signal or retrieve the excitation signal from a local or remote database. The excitation signal may represent the signal that would be detected immediately or near vocal chords (e.g., without modifications by the whole vocal tract, sound radiation characteristics from the mouth etc). Excitation signals in form of pitch pulse prototypes may be retrieved from a local or remote database generated during prior training sessions.

Some methods extract spectral envelopes from the second microphone signal through coding methods. A Linear Predictive Coding (LPC) method may be used. In this method the n-th sample of a time signal x(n) may be estimated from M preceding samples as $$x(n) = \sum_{k=1}^{M} a_k(n) \cdot x(n-k) + e(n)$$

The coefficients $a_k(n)$ are optimized to minimize the predictive error signal e(n). The optimization may be processed recursively by, e.g., the Least Mean Square processor or method.

The shaping of an excitation spectrum through a spectral envelope (e.g., a curve that connects points representing the amplitudes of frequency components in a tonal complex) synthesizes speech efficiently. The use of a substantially unaffected or unperturbed spectral envelop extracted from the second microphone signal allows the process to reliably reconstruct portions of the first microphone signal that may be affected by noise or distortions.

Figure 3:
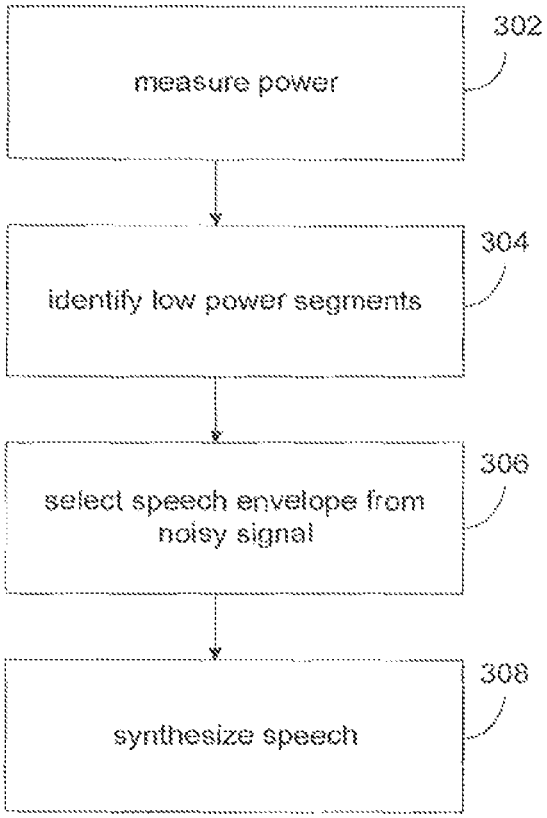
FIG. 3 is a second alternative speech enhancement process.

Some processes may extract an envelope and/or an excitation signal from a signal affected by noise or distortions. In the method of FIG. 3, a spectral envelope may be extracted from the first microphone signal. The portion of the first microphone signal having a signal-to-noise ratio below the predetermined level may be synthesized through this spectral envelope at 302 and 304. The synthesis may depend on a signal-to-noise ratio lying within a predetermined range below the predetermined level or may exceed the corresponding signal-to-noise ratio of second microphone signal. In some methods the synthesis is contingent on the signal to noise ratio lying within a predetermined range below the corresponding signal-to-noise determined for the second microphone signal.

When an estimate of the spectral envelope based on the first microphone signal is considered reliable, the spectral envelope used to synthesize speech may be extracted from the first microphone signal 306 and the speech segment may be synthesized at 308. This situation may occur when the first microphone is expected to receive a more powerful contribution of the wanted signal (speech signal representing the speaker's utterance) than the second microphone.

In some processes where the signal-to-noise ratio of a portion of the first microphone signal is below the predetermined level, a signal portion may be synthesized through a spectral envelope extracted from the second microphone signal. This may occur in some alternative processes when the determined wind noise in the second microphone signal is below a predetermined wind noise level. This might occur when no or little wind noise is detected in the second microphone signal.

Portions of the first microphone signal that exhibit a sufficiently high SNR (SNR above the above-mentioned predetermined level) may not be (re-)synthesized. These portions may be filtered to dampen noise. A noise reduction may occur through hardware or software that selectively passes certain signal elements while minimizing or eliminating others (e.g., a Wiener filter). The noise reduced signal parts and the synthesized portions may be combined to achieve an enhanced speech signal.

Figure 4:
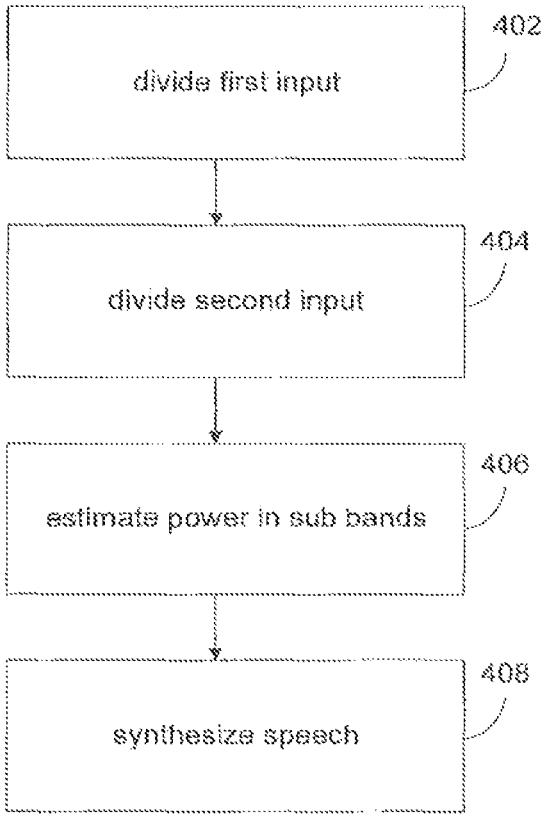
FIG. 4 is a third alternative speech enhancement process.

In a speech enhancement, signal processing may be performed in the frequency domain (employing the appropriate Discrete Fourier Transformations and the corresponding Inverse Discrete Fourier Transformations) or in the sub-band domain. In these processes (one shown in FIG. 4), a system may divide the first microphone signal into first microphone sub-band signals at 402 and the second microphone signal into second microphone sub-band signals at 404. The amount of power (e.g., the signal-to-noise ratio) in each of the first microphone sub-band signals may be measured or estimated at 406. In this enhancement, the first microphone sub-band signals synthesized may correspond to those signal portions that have less power (e.g., a lower signal-to-noise ratio) than a predetermined level at 408. The processed sub-band signals may be passed through a synthesis filter bank to generate a full-band signal. A synthesis in the context of the filter bank may refer to the synthesis of sub-band signals to a full-band signal rather than a speech (re-)synthesis.

Figure 5:
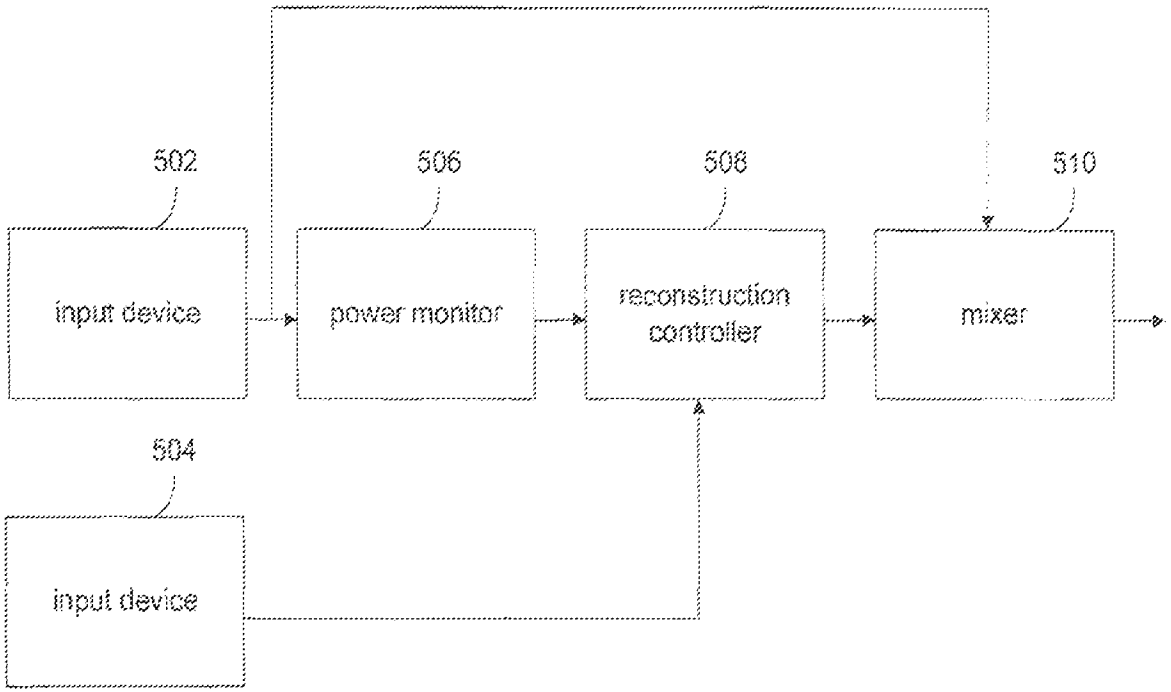
FIG. 5 is a speech enhancement system.

A speech synthesis system may also synthesize an input signal affected by distortion. The system of FIG. 5 may include a first input 502 that is configured to receive a first microphone signal. The microphone signal may include content that represents a speaker's utterance and may include noise. A second input 504 may receive a second microphone signal that includes content representing the speaker's utterance. A power monitor 506 may determine a signal-to-noise ratio of the first microphone signal. A reconstruction device 508 may synthesize a portion of the first microphone signal for which the determined signal-to-noise ratio is below a predetermined level. The synthesis may be based on the second microphone signal.

The reconstruction device 508 may comprise a controller configured to extract a spectral envelope from the second microphone signal. The controller may synthesize at least one part of the first microphone signal for which the determined signal-to-noise ratio is below the predetermined level through the extracted spectral envelope.

Some systems may communicate and access data from an optional local or remote database that retains samples of excitation signals. In these systems, the reconstruction device 508 synthesizes portions of the first microphone signal that have (or estimated to have) a signal-to-noise ratio below the predetermined level by accessing and processing the stored samples of excitation signals.

Some systems may also include a noise filter (e.g., a Wiener filter). The noise filter may dampen or reduce noise in portions of the first microphone signal that exhibit a signal-to-noise ratio (or power level) above a predetermined level. The filter may render noise reduced signals.

The reconstruction device may include an optional mixer 510 that combines and adjusts the synthesized portions of the first microphone signal and the noise reduced signal parts that pass through the noise filter. The mixer may transmit an enhanced digital speech signal with an improved intelligibility.

An alternative system may include a first analysis filter bank configured to divide the first microphone signal into first microphone sub-band signals. A second analysis filter bank may divide the second microphone signal into second microphone sub-band signals. A synthesis filter bank may synthesize sub-band signals that become part of a full-band signal.

In this alternative system signal processing may occur in the sub-band domain. The signal-to-noise ratio may be determined for each of the first microphone sub-band signals. The first microphone sub-band signals are synthesized (or reconstructed) that exhibit a signal-to-noise ratio below the predetermined level. In these systems at least one first microphone generates the first microphone signal, and at least one second microphone generates the second microphone signal. The speech synthesis (or communication) system may be part of a vehicle or other communication environment.

Like the speech synthesis methods, the systems may efficiently discriminate between speech and noise in enclosed and nosy environments. In some systems, a first microphone may be installed in a vehicle and a second microphone may be installed in the vehicle or may be part of a mobile device, like a mobile phone, a personal digital assistant, or a navigation system (e.g., portable navigation device), that may communicate with the vehicle through a wireless or tangible medium, for example. The systems may be part of a hands-free set that interface or communicate with an in-vehicle communication system, a mobile device (e.g., a mobile phone, a personal digital assistant, or a portable navigation device), and/or a local or remote speech dialog system.

Figure 6:
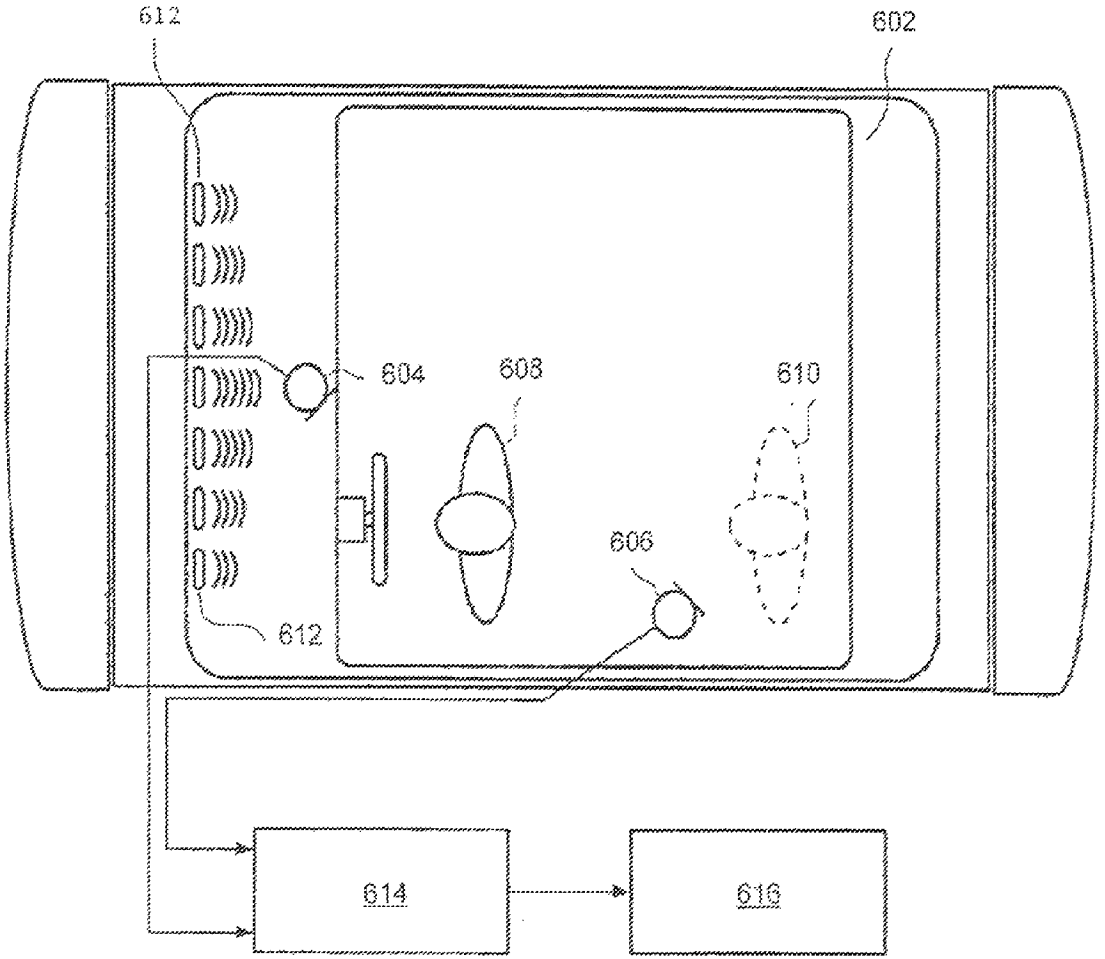
FIG. 6 is vehicle interior that includes a speech enhancement system.

FIG. 6 is vehicle interior 602 that includes a speech enhancement. In the vehicle interior 602, a hands-free communication system comprises microphones 604 (or input devices or arrays) positioned near the front of the vehicle (e.g., close to a driver 608). A second input or microphone 606 is positioned in the rear of the vehicle (e.g., near a back seat passenger 610). The microphones 604 and 606 may interface an in-vehicle speech dialog system that facilitates communication between the driver 608 and the rear seat passenger 610. The microphones 604 and 606 may facilitate hands-free communication (e.g., telephony) with a remote party that may be remote from the vehicle. The microphone 604 may interface an operating panel or may be positioned in proximity to a ceiling or elevated position within the vehicle.

In some situations, a driver's 608 speech (detected by the front microphone 604) may be transmitted to a loudspeaker (not shown) or another output near the rear of the vehicle or remote from the vehicle. A front microphone 604 may detect the driver's utterance and some localized noise. The noise may be generated by a climate control system that services vehicle interior 602. Air jets (or nozzles) 612 positioned near the front of the vehicle may generate wind streams and associated wind noise. Since the air jets 612 may be positioned in proximity to the front microphone 604, the microphone signal $x_1(n)$ may reflect undesired changes caused by wind noise in the lower frequency of the audible spectrum. The speech signal transmitted to a receiving party (e.g., the back seat passenger or remote party) may be distorted if not further enhanced.

In FIG. 6, a driver's utterance may also be detected by the rear microphone 606. While the rear microphone 606 may be configured to detect utterances by the back seat passenger 610 it may also detect the driver's utterance (in particular, during speech pauses of the back seat passenger). In some applications the rear microphone 606 may be configured to enhance the microphone signal generated by the first input or microphone 604.

In some environments, the rear microphone 606 may not detect or detect small amounts wind noise generated by the front climate control system. The low-frequency range of the microphone signal $x_2(n)$ obtained by the rear microphone 606 may not be affected (or may be minimally affected) by the wind noise distortion. Information contained in this low-frequency range (that may not be available or may be masked in the first microphone signal $x_1(n)$ due to the noise) may be extracted and used for speech enhancement in the signal processing unit 614.

The signal processing unit 614 may receive microphone signal $x_1(n)$ generated by the front microphone 604 and the microphone signal $x_2(n)$ generated by the rear microphone 606. For the frequency range(s) in which no significant wind noise is present the microphone signal $x_1(n)$ obtained by the front microphone 604 may be filtered to eliminate or reject noise. The noise filter may interface or may be part of the signal processing unit 614. It may comprise a Wiener filter. Some filters may not effectively discriminate or reject interference caused by wind noise. In a low frequency range subject to wind noise, a microphone signal $x_1(n)$ may be synthesized. The synthesis may extract a spectral envelope from a microphone signal (e.g., $x_2(n)$) that is not or less affected by wind interference. For partial speech synthesis, an excitation signal (pitch pulse) may be estimated. In some systems in which processing occurs in the frequency sub-band domain, a speech signal portion synthesized by the signal processing unit 614 may comprise $$\hat{S}_r(e^{j\Omega_\mu},n)=\hat{E}(e^{j\Omega_\mu},n)\hat{A}(e^{j\Omega_\mu},n)$$

where $\Omega_\mu$ and n denote the sub-band and the discrete time index of the signal frame and $\hat{S}_r(e^{j\Omega_\mu}, n)=\hat{E}(e^{j\Omega_\mu}, n)$ and $\hat{A}(e^{j\Omega_\mu}, n)$ denote the synthesized speech sub-band signal, the estimated spectral envelope and the excitation signal spectrum, respectively.

The signal processing unit 614 may discriminate between voiced and unvoiced signals and cause synthesis of unvoiced signals by noise generators. When a voiced signal is detected, the pitch frequency may be determined and the corresponding pitch pulses may be set or programmed in intervals of the pitch period. The excitation signal spectrum may be retrieved from a database that comprises excitation signal samples (pitch pulse prototypes). In some systems speaker dependent excitation signal samples may be stored or trained prior to the enhancement. In alternative systems, the database may be populated during enhancement processing.

The signal processing unit 614 may combine signal portions (sub-band signals) that are noise reduced with synthesized signal portions based on power levels (e.g., according to current signal-to-noise ratio). In some applications signal portions of the microphone signal $x_1(n)$ that are heavily distorted by the wind noise may be reconstructed through the spectral envelope extracted from the microphone signal $x_2(n)$ generated by the rear microphone 606. The combined enhanced speech signal y(n) may be transmitted or received by input in a speech dialog system 116 that services a vehicle interior 602, a telephone 616, a wireless device, etc.

Figure 7:
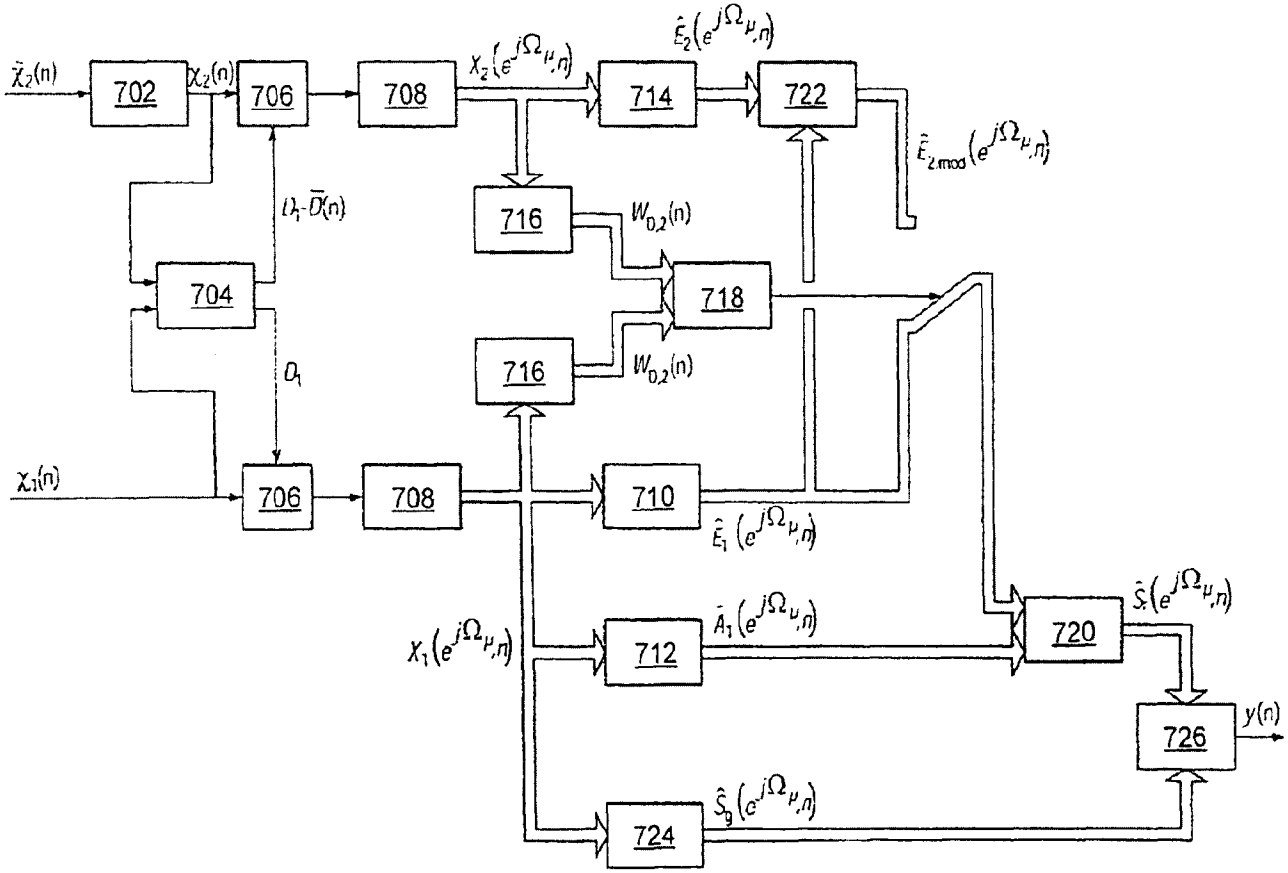
FIG. 7 is a signal processor of a speech enhancement that interfaces wind noise detection units, a noise reduction filter, and a speech synthesizer.

FIG. 7 is a signal processor of a speech enhancement that interfaces wind noise detector, a noise reduction filter, and a speech synthesis. In FIG. 7 a first microphone signal $x_1(n)$ that contains wind noise is received by the signal processor and is enhanced through a second microphone signal $\tilde{x}_2(n)$ transmitted by (or supplied from) a mobile or wireless device (e.g., a wireless phone, a communication through a Bluetooth link, etc.).

In some applications, the mobile device may be positioned to receive little or less wind noise than another microphone (e.g., may generate a first microphone signal $x_1$ (n)). The sampling rate of the second microphone signal $\tilde{x}_2(n)$ may be dynamically adapted to a first microphone signal $x_1(n)$ by a sampling rate adaptation unit 702. The second microphone signal after an adaptation of the sampling rate may be denoted by $x_2(n)$.

Since the microphone used to obtain the first microphone signal $x_1(n)$ (in the present example, a microphone positioned in a vehicle interior) and the microphone of the mobile device are separated, the corresponding microphone signals including speaker's utterance may be subject to different signal travel times. The system may determine these different travel times D(n) through a correlator 704 performing a cross correlation analysis $$D(n) = \underset{k}{\operatorname{argmax}} \left\{ \sum_{m=0}^{M-1} x_i(n-m-k)x_2(n-m) \right\}$$

where the number of input values used for the cross correlation analysis M can be chosen, e.g., as M=512, and the variable k satisfies $0 \le k \le 70$. The cross correlation analysis is repeated periodically and the respective results are averaged $\overline{D}(n)$) to correct for outliers. In addition, some systems detect speech activity and perform averaging only when speech is detected.

The smoothed (averaged) travel time difference $\overline{D}(n)$ may vary. In some applications a fixed travel time $D_1$ may be introduced in the signal path of the first microphone signal $x_1(n)$ that represents an upper limit of the smoothed travel time difference $\overline{D}(n)$ and a travel time $D_2=D_1-\overline{D}$ is introduced accordingly in the signal path for $x_2(n)$ by the delay units 706.

The delayed signals may be divided into sub-band signals $X_1(e^{j\Omega_\mu}, n)$ and $X_2(e^{j\Omega_\mu}, n)$, respectively, by analysis filter banks 708. The filter banks may comprise Hann or Hamming windows, for example. The sub-band signals $X_1(e^{j\Omega_\mu}, n)$ are processed by units 710 and 712 to obtain estimates of the spectral envelope $\hat{E}_1(e^{j\Omega_\mu}, n)$ and the excitation spectrum $\hat{A}_1(e^{j\Omega_\mu}, n)$ Unit 714 is supplied with the sub-band signals $X_2(e^{j\Omega_\mu}, n)$ of the (delayed) second microphone signal $x_2(n)$ and extracts the spectral envelope $\hat{E}_2(e^{j\Omega_\mu}, n)$.

In this exemplary explanation, the first microphone signal $x_1(n)$ is affected by wind noise in a low-frequency range, e.g., below 500 Hz. Wind detecting units 716 may be programmed with the signal processor 614 of FIG. 6. The signal processor 614 may analyze the sub-band signals and provide signals $W_{D,1}(n)$ and $W_{D,2}(n)$ that indicate the presence or absence of a wind noise or a significant wind noise to a control unit 718. The system may synthesize signal parts of the first microphone signal $x_1(n)$ that are heavily affected by wind noise.

The synthesis may be performed based on the spectral envelope $\hat{E}_1(e^{j\Omega_\mu}, n)$ or the spectral envelope $\hat{E}_2(e^{j\Omega_\mu}, n)$. The spectral envelope $\hat{E}_1(e^{j\Omega_\mu}, n)$ may be used, if significant wind noise is detected only in the first microphone signal $x_1(n)$. Based on signals $W_{D,1}(n)$ and $W_{D,2}(n)$, the control unit 718 determines whether the spectral envelope $\hat{E}_1(e^{j\Omega_\mu}, n)$ or the spectral envelope $\hat{E}_2(e^{j\Omega_\mu}, n)$ or a combination of $\hat{E}_1(e^{j\Omega_\mu}, n)$ and $\hat{E}_2(e^{j\Omega_\mu}, n)$ is used by the synthesis unit 720 for the partial speech reconstruction.

Before the spectral envelope $\hat{E}_2(e^{j\Omega_\mu}, n)$ is used for synthesis of noisy portions of the first microphone signal $x_1(n)$, a power density adaptation process may be executed. The process may adapt the first and the second microphone signals that may exhibit different sensitivities.

Since wind noise perturbations may be present in a low-frequency range, the spectral adaptation unit 722 may adapt the spectral envelope $\hat{E}_2(e^{j\Omega_\mu}, n)$ according to $$\hat{E}_{2,mod}(e^{j\Omega\mu}, n) = V(n)\hat{E}_2(e^{j\Omega\mu}, n) \text{ with } V(n) = \sqrt{\frac{\sum_{\mu=\mu_0}^{\mu_1} |\hat{E}_1(e^{j\Omega\mu}, n)|^2}{\sum_{\mu=\mu_0}^{\mu_1} |\hat{E}_2(e^{j\Omega\mu}, n)|^2}},$$

where the summation is carried out for a relatively high-frequency range only, ranging from a lower frequency sub-band $\mu_0$ to a higher one $\mu_1$, e.g., from $\mu_0$=about 1000 Hz to $\mu_1$ about 2000 Hz. This adaptation may be modified depending on the actual SNR, e.g., by replacing V(n) by V(n)z(SNR), with z(SNR)=1, if the SNR exceeds a predetermined value and else z=about 0 or similar linear or nonlinear functions.

After the power adaptation, the spectral envelope obtained from the second microphone signal $x_2(n)$ may be processed by the synthesis unit 720 to shape the excitation spectrum obtained by the unit 712:

$$\hat{S}_r(e^{j\Omega_\mu}, n) = \hat{E}_{2,mod}(e^{j\Omega_\mu}, n)\hat{A}_1(e^{j\Omega_\mu}, n).$$

In some applications, only parts of the noisy microphone signal $x_1(n)$ are reconstructed. The other portions exhibiting a sufficiently high SNR may be filtered or passed without rejecting or eliminating signals. The signal processor 614 shown in FIG. 6 may include or comprises a noise filter 724 that receives sub-band signals $X_2(e^{j\Omega_\mu}, n)$ and selectively passes noise reduced sub-band signals $\hat{S}_g(e^{j\Omega_\mu}, n)$. These noise reduced sub-band signals $\hat{S}_g(e^{j\Omega_\mu}, n)$ and the synthesized signals $\hat{S}_r(e^{j\Omega_\mu}, n)$ obtained by the synthesis unit 720 may be combined and adjusted by a mixing unit 726. In a mixing unit 726 the noise reduced and synthesized signal portions may be combined depending on the respective power levels (e.g., determined SNR levels for the individual sub-bands). In some systems SNR levels are pre-selected or pre-programmed and sub-band signals $X_1(e^{j\Omega_\mu}, n)$ that exhibit an SNR exceeding this predetermined level are replaced by the synthesized signals $\hat{S}_r(e^{j\Omega_\mu}, n)$.

In frequency ranges in which no significant wind noise is present noise reduced sub-band signals may be processed by the noise filter 724 to generate the enhanced full-band output signal y(n). To achieve the full-band signal y(n), the sub-band signals selected from $\hat{S}_g(e^{j\Omega_\mu}, n)$ and $\hat{S}_r(e^{j\Omega_\mu}, n)$ that may depend on the SNR) may be subject to filtering by a synthesis filter bank that may interface or may be part of the mixing unit 726 and may include a common window function that may be used in the analysis filter banks 708.

In FIG. 7 different units and devices may be identified that are not necessary. The structure and functions may be logically and/or physically separated or may be part of unitary devices. Other alternate systems and methods may include combinations of some or all of the structure and functions described above or shown in one or more or each of the figures. These systems or methods are formed from any combination of structures and function described or illustrated within the figures.

The methods, systems, and descriptions above may be encoded in a signal bearing storage medium, a computer readable medium or a computer readable storage medium such as a memory that may comprise unitary or separate logic, programmed within a device such as one or more integrated circuits, or processed by a controller or a computer. If the methods or system descriptions are performed by software, the software or logic may reside in a memory resident to or interfaced to one or more processors or controllers, a communication interface, a wireless system, body control module, an entertainment and/or comfort controller of a vehicle or non-volatile or volatile memory remote from or resident to the a speech recognition device or processor. The memory may retain an ordered listing of executable instructions for implementing logical functions. A logical function may be implemented through digital circuitry, through source code, through analog circuitry, or through an analog source such as through an analog electrical, or audio signals.

The software may be embodied in any computer-readable storage medium or signal-bearing medium, for use by, or in connection with an instruction executable system or apparatus resident to a vehicle, audio system, or a hands-free or wireless communication system. Alternatively, the software may be embodied in a navigation system or media players (including portable media players) and/or recorders. Such a system may include a computer-based system, a processor-containing system that includes an input and output interface that may communicate with an automotive, vehicle, or wireless communication bus through any hardwired or wireless automotive communication protocol, combinations, or other hardwired or wireless communication protocols to a local or remote destination, server, or cluster.

A computer-readable medium, machine-readable storage medium, propagated-signal medium, and/or signal-bearing medium may comprise any medium that contains, stores, communicates, propagates, or transports software for use by or in connection with an instruction executable system, apparatus, or device. The machine-readable storage medium may selectively be, but not limited to, an electronic, magnetic, optical, electromagnetic, infrared, or semiconductor system, apparatus, device, or propagation medium. A non-exhaustive list of examples of a machine-readable medium would include: an electrical or tangible connection having one or more links, a portable magnetic or optical disk, a volatile memory such as a Random Access Memory "RAM" (electronic), a Read-Only Memory "ROM," an Erasable Programmable Read-Only Memory (EPROM or Flash memory), or an optical fiber. A machine-readable medium may also include a tangible medium upon which software is printed, as the software may be electronically stored as an image or in another format (e.g., through an optical scan), then compiled by a controller, and/or interpreted or otherwise processed. The processed medium may then be stored in a local or remote computer and/or a machine memory.

While various embodiments of the invention have been described, it will be apparent to those of ordinary skill in the art that many more embodiments and implementations are possible within the scope of the invention. Accordingly, the invention is not to be restricted except in light of the attached claims and their equivalents.

What is claimed is:

1. A signal processing method comprising:

detecting a speaker's utterance by at least one first microphone to obtain a first microphone signal;

detecting the speaker's utterance by at least one second microphone to obtain a second microphone signal wherein the second microphone detects less interference from a source of interference as compared to the first microphone;

determining a signal-to-noise ratio of the first microphone signal; and synthesizing at least one part of the first microphone signal for which the determined signal-to-noise ratio is below a predetermined level based on the second microphone signal.

2. The signal processing method according to claim 1, wherein the signal processing method operates within a vehicle.

3. The signal processing method according to claim 2, wherein the first microphone is installed in the vehicle.

4. The signal processing method according to claim 2, wherein the second microphone is located within the vehicle.

5. The signal processing method according to claim 4 wherein the second microphone is installed in the vehicle.

6. The signal processing method according to claim 1, wherein the second microphone is part of a portable mobile communications device.

7. The signal processing method according to claim 1 wherein the source of interference is wind noise.

8. The signal processing method according to claim 2 wherein the source of interference is air flow produced by a heating/cooling system within the vehicle.

9. The signal processing method according to claim 1 further comprising:

extracting a spectral envelope from the second microphone signal; and where the at least one part of the first microphone signal for which the determined signal-to-noise ratio is below the predetermined level is synthesized through the spectral envelope extracted from the second microphone signal and an excitation signal extracted from the first microphone signal, the second microphone signal or retrieved from a local database.

10. The signal processing method according to claim 9 further comprising extracting a spectral envelope from the first microphone signal and synthesizing at least one part of the first microphone signal for which the determined signal-to-noise ratio is below the predetermined level through the spectral envelope extracted from the first microphone signal, if the determined signal-to-noise ratio lies within a predetermined range below the predetermined level or exceeds the corresponding signal-to-noise determined for the second microphone signal or lies within a predetermined range below the corresponding signal-to-noise determined for the second microphone signal.

11. The signal processing method according to claim 9 further comprising:

dampening interference from at least parts of the first microphone signal that exhibit a signal-to-noise ratio above the predetermined level to obtain noise reduced signal parts.

12. The signal processing method according to claim 11 wherein dampening is achieved using a Wiener filter.

13. The signal processing method according to claim 11 further comprising combining the at least one synthesized part of the first microphone signal and the noise reduced signal parts.

14. The signal processing method of claim 9 further comprising dividing the first microphone signal into first microphone sub-band signals and the second microphone signal into second microphone sub-band signals and where the signal-to-noise ratio is determined for each of the first microphone sub-band signals and where first microphone sub-band signals are synthesized which exhibit a signal-to-noise ratio below the predetermined level.

15. The signal processing method according to claim 14 where the at least one part of the first microphone signal for which the determined signal-to-noise ratio is below the predetermined level is synthesized through the spectral envelope extracted from the second microphone signal only, when the determined wind noise in the second microphone signal is below a predetermined wind noise level and when substantially little wind noise is present in the second microphone signal.

16. A non-transitory computer-readable storage medium that stores instructions that, when executed by processor, cause the processor to enhance speech communication by executing software that causes the following acts comprising:

detecting a speaker's utterance by at least one first microphone to obtain a first microphone signal;

detecting the speaker's utterance by at least one second microphone to obtain a second microphone signal, wherein the second microphone detects less interference from a source of interference as compared to the first microphone;

determining a signal-to-noise ratio of the first microphone signal; and synthesizing at least one part of the first microphone signal for which the determined signal-to-noise ratio is below a predetermined level based on the second microphone signal.

17. A non-transitory computer-readable storage medium according to claim 16, wherein the first microphone is installed within a vehicle.

18. The non-transitory computer-readable storage medium according to claim 16, wherein the second microphone is installed in a vehicle.

19. The non-transitory computer-readable storage medium according to claim 16, wherein the second microphone is located within a vehicle.

20. The non-transitory computer-readable storage medium according to claim 16, wherein the second microphone is part of a portable mobile communications device.

21. The non-transitory computer-readable storage medium according to claim 16 wherein the source of interference is wind noise.

22. The non-transitory computer-readable storage medium according to claim 16 wherein the source of interference is air flow produced by a heating/cooling system within a vehicle.

23. The non-transitory computer-readable storage medium according to claim 16 further comprising:

extracting a spectral envelope from the second microphone signal; and where the at least one part of the first microphone signal for which the determined signal-to-noise ratio is below the predetermined level is synthesized through the spectral envelope extracted from the second microphone signal and an excitation signal extracted from the first microphone signal, the second microphone signal or retrieved from a local database.

24. The non-transitory computer-readable storage medium according to claim 23 further comprising:

dampening interference from at least parts of the first microphone signal that exhibit a signal-to-noise ratio above the predetermined level to obtain noise reduced signal parts.

25. The non-transitory computer-readable storage medium according to claim 24 further comprising:

combining the at least one synthesized part of the first microphone signal and the noise reduced signal parts.

26. The non-transitory computer-readable storage medium according to claim 16 further comprising:

extracting a spectral envelope from the first microphone signal and synthesizing at least one part of the first microphone signal for which the determined signal-to-noise ratio is below the predetermined level through the spectral envelope extracted from the first microphone signal, if the determined signal-to-noise ratio lies within a predetermined range below the predetermined level or exceeds the corresponding signal-to-noise determined for the second microphone signal or lies within a predetermined range below the corresponding signal-to-noise determined for the second microphone signal.

27. The signal processing method of claim 16 further comprising dividing the first microphone signal into first microphone sub-band signals and the second microphone signal into second microphone sub-band signals and where the signal-to-noise ratio is determined for each of the first microphone sub-band signals and where first microphone sub-band signals are synthesized which exhibit a signal-to-noise ratio below the predetermined level.

* * * * *